US007503711B2

(12) United States Patent
Arkin

(10) Patent No.: US 7,503,711 B2
(45) Date of Patent: Mar. 17, 2009

(54) TAPE PRINTING APPARATUS AND METHOD OF PRINTING

(75) Inventor: Michael N. Arkin, Beachwood, OH (US)

(73) Assignee: Kroy LLC, Cleveland, OH (US)

( * ) Notice: Subject to any disclaimer, the term of this patent is extended or adjusted under 35 U.S.C. 154(b) by 287 days.

(21) Appl. No.: 11/077,376

(22) Filed: Mar. 10, 2005

(65) Prior Publication Data

US 2005/0201796 A1 Sep. 15, 2005

Related U.S. Application Data

(60) Provisional application No. 60/552,041, filed on Mar. 10, 2004.

(51) Int. Cl.
*B41J 29/38* (2006.01)
*B41J 3/36* (2006.01)

(52) U.S. Cl. ..... 400/76; 400/61

(58) Field of Classification Search ..... 400/60, 400/61, 70, 76, 611–621.1
See application file for complete search history.

(56) References Cited

U.S. PATENT DOCUMENTS 5,081,594 A 1/1992 Horsley
5,230,572 A 7/1993 Hirono et al.
5,314,256 A 5/1994 Niwa
5,322,375 A 6/1994 Niwa et al.
5,344,247 A 9/1994 Sakuragi et al.
5,374,131 A 12/1994 Ito et al.
5,382,100 A 1/1995 Sakuragi et al.
5,393,147 A 2/1995 Ueno et al.
5,399,030 A 3/1995 Niwa et al.
5,403,101 A 4/1995 Nagase et al.
5,411,339 A 5/1995 Bahradbadi et al.
5,435,659 A 7/1995 Ueno
5,462,372 A 10/1995 Hirono
5,464,290 A 11/1995 Watanabe et al.
5,480,244 A * 1/1996 Senda ..... 400/582
5,496,116 A 3/1996 Senda
5,496,118 A 3/1996 Ueno et al.
5,496,119 A 3/1996 Kawakami et al.
5,503,482 A 4/1996 Kawakami et al.
5,533,818 A 7/1996 Bahrabadi
5,540,507 A 7/1996 Niwa et al.
5,549,399 A 8/1996 Sakuragi et al.
5,609,424 A 3/1997 Sakuragi et al.
RE35,562 E 7/1997 Hirono et al.
5,649,775 A 7/1997 Sakuragi et al.
5,651,619 A 7/1997 Nunokawa et al.
5,868,504 A 2/1999 Nunokawa et al.
5,967,679 A 10/1999 Beadman et al.
5,980,133 A 11/1999 Nunokawa et al.
6,109,798 A 8/2000 Nunokawa et al.
6,373,510 B1 4/2002 Hosokawa et al.

FOREIGN PATENT DOCUMENTS

EP 0 738 213 10/1996

* cited by examiner

*Primary Examiner*—Daniel J Colilla
(74) *Attorney, Agent, or Firm*—Dorsey & Whitney LLP; Nathan J. Witzany

(57) ABSTRACT

A printing apparatus and method of printing for maximizing a print image in a print area in both a width and length dimension and for automatically formatting the printer depending on the type of tape media.

12 Claims, 14 Drawing Sheets

Auto Size g descender
Auto size = 70 pt - length = auto

Auto Size g ascender & descender
Auto size = 60 pt - length = auto

FIG. 13A

Auto Size

Auto size = 72 pt - length = auto

FIG. 13B

Å uto Size ascender

Auto size = 72 pt - length = auto

FIG. 13C

Auto Size g descender

Auto size = 70 pt - length = auto

FIG. 13D

Å uto Size g ascender & descender

Auto size = 60 pt - length = auto

FIG. 13E

Å uto Size g ascender & descender & page frame

Auto size = 52 pt - length = auto

FIG. 13F

Auto Size length user set to 3.0"

Auto size = 49 pt - length = 3.0"

FIG. 13G

Auto Size length user set to 1.0"

Auto size = 16 pt - length = 1.0"

FIG. 14A

Auto Size
Line 2
Longer line 3

Auto size = 24 pt - length = auto

FIG. 14B

Auto Size
Line 2
Longer line 3 frame on line 2

Auto size = 21 pt - length = auto

FIG. 14C

Auto Size
Line 2
Longer line 3 frame on line 2
frame on page

Auto size = 19 pt - length = auto

FIG. 15A

Auto Size
Line 2
Longer line 3

Auto size = 11 pt - length = auto

FIG. 15B

Auto Size
Line 2
Longer line 3

Auto size = 10 pt - length = auto

FIG. 15C

Auto Size
Line 2
Longer line 3

Auto size = 9 pt - length = auto

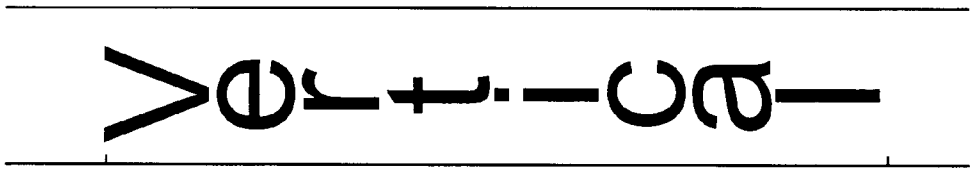
Auto size = 69 pt - length = auto, rotate = off
FIG. 17A
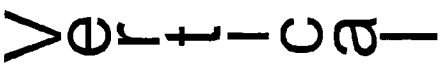
Auto size = 38 pt - length = 3.0", rotate = off
FIG. 17B
Vertical
Auto size = 11 pt , rotate = on
FIG. 17C
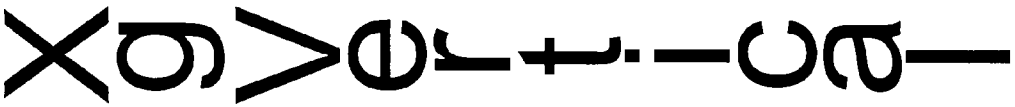
FIG. 17D
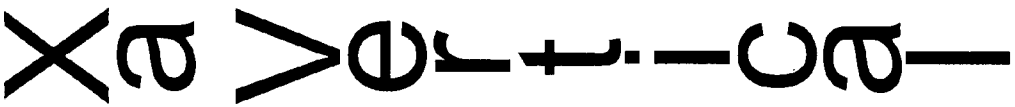
FIG. 17E

TAPE PRINTING APPARATUS AND METHOD OF PRINTING

BACKGROUND OF THE INVENTION

1. Field of the Invention

The present invention relates to a tape printing apparatus and method of printing and more specifically to a cartridge based tape printing apparatus in which characteristics of the cartridge and the tape within the cartridge are automatically communicated to the printer upon insertion of the cartridge and in which the size of a character or string of characters to be printed can be automatically maximized and adjusted to fit both a width characteristic and a length characteristic of such tape for both normal and rotated text and for both single and multiple lines.

2. Description of the Prior Art

Various cartridge based, tape printing systems currently exist in the art. Most of these systems include a print cartridge having a supply of image receiving tape or image receiving tape in combination with a print ribbon and a printing apparatus having a thermal print head and a platen roller. When actuated, the printing apparatus functions to form or transfer an image such as letters, numerals, symbols or other characters onto the image receiving tape. Examples of such cartridge based print systems are those shown in U.S. Pat. Nos. 5,314,256; 5,322,375; 5,533,818 and 5,649,775. Many cartridge based systems, and in particular the cartridge based system of U.S. Pat. No. 5,533,818, include means for the cartridge to automatically communicate to the printer, specific characteristics of the tape within the printer such as, but not limited to, tape width, tape type, etc.

In these systems, the data indicative of the various printable characters are stored in a font storage means within a portion of the printing apparatus. This data can be stored in the form of bit maps or otherwise as disclosed in U.S. Pat. No. 5,649,775, the entirety of which is hereby incorporated by reference, in the form of scalable outline data as disclosed in U.S. Pat. No. 5,081,594, the entire substance of which is incorporated herein by reference in the form of Bezier font data as disclosed in U.S. Pat. No. 5,967,679, the entire substance of which is incorporated herein by reference, or in any other form such as in vector graphic form or by representing the character as mathematical formulas.

These prior cartridge based print systems also include input means for inputting character code data and other instructions to define the characters to be printed on the tape as well as other properties of those characters including lettering style, lettering size, etc. Many of these systems also include a means which prevents the printer from printing a character of a particular selected size if that character would exceed the tape width.

Some of these systems, and in particular those described in U.S. Pat. Nos. 5,322,375 and 5,649,775 have an "auto" or "automatic" print mode in which a comparison is made between certain preselected characters to be printed and the width of the tape for purpose of calculating and printing the maximum character size for that particular width of tape. Specifically, U.S. Pat. No. 5,322,375 examines the stored input data corresponding to the characters to be printed and, if they all belong to a preselected type of data (such as capital letters and numerals), the printer generates a printing instruction in which the print size will be maximized (for the available print sizes stored in the printer) relative to the allowable print width of the tape.

U.S. Pat. No. 5,649,775 discloses a print system which improves upon the disclosure in U.S. Pat. No. 5,322,375 by making it applicable to characters other than certain preselected characters and by providing a printing baseline adjustment, depending upon the particular characters to be printed.

U.S. Pat. No. 5,314,256 discloses a printing system capable of printing a plurality of characters in a plurality of lines on a tape and determines the size of the characters to be printed based upon the number of lines to be printed and the number of characters to be printed within a predetermined area on the tape.

While the current systems function satisfactorily, for the most part, to maximize the size of print relative to the tape width, none of the prior art fully addresses maximizing the size of the characters to be printed for both a particular tape width and a particular tape length. Although many applications exist where the length of the characters to be printed is of no concern, some applications require the printed characters to be printed onto a tape or tape portion of defined length, such as a die cut label or a wirewrap application or the like.

Accordingly, there is a need in the art for an improved cartridge based print system which not only automatically maximizes the size of the characters to be printed to the tape width, but also ensures that the printed characters will fully fit within the predetermined or selected tape length as well. This need exists with respect to single line text and multiple line text as well as text which is rotated or printed vertically.

SUMMARY OF THE INVENTION

The present invention is directed to a cartridge based tape printing system in which the individual characters to be printed are examined and the maximum character point size is determined which will both fit the allowable print width of the tape as well as the allowable print length of the tape. In a preferred embodiment of such system, the tape width (or allowable print width) is automatically communicated to the printer upon insertion of the cartridge into the printer and the allowable print length is either automatically communicated to the printer upon insertion of the cartridge or is inputted by the user. In all cases, the determination of the maximum character print size is determined by examining the size of each individual character as well as individual character attributes, line attributes, page attributes and any other input data that would affect the width or length dimension of the printed block or page.

Preferably, in addition to the individual size characteristics of the inputted characters and the various character, line and page attributes set forth above, the line dimension of a character string will also take into account the ability of certain character pairs to interlock when positioned adjacent to one another, often referred to as "kerning". This character point size maximizing in accordance with the invention is applicable whether the printer is in the rotated or non-rotated print mode, or whether it is in the normal or vertical print mode, or whether a single line or multiple lines are being printed.

Accordingly, the present invention includes within its memory, or within a connected PC, scalable outline character data that is resident in the print system memory or is resident in the PC and convertable to a form usable by the print system of the present invention.

The print system of the present invention includes an "auto size" feature. The "auto size" feature is invoked via a key on the keyboard of the printer, a multi-key keyboard sequence, or a menu selection choice within the menu user interface of the printer. There is also a preference selection within the menu user interface that controls whether the "auto size" feature is enabled when the printer is powered on. When the "auto size" feature is selected, the routine within the print system maximizes the printable character size in two dimensions (width and length) of the tape media. Accordingly, the "auto size" feature in accordance with the present invention includes a means for calculating the length of each line in a print block and determining the longest line; means for calculating the height of each line in the print block and the sum of the heights of all lines; means for comparing the maximum length or the total height to either the allowable print width or allowable print length (depending on whether in a "rotate" mode or not); means for determining the maximum character size that would fit on such allowable tape width or tape length; and means for determining the maximum character size that would fit on the other of the maximum line length and total height of the other of such allowable print width and allowable print length.

A further feature of the present invention includes determining the type of tape media within the cartridge and if it is wirewrap, automatically setting the printer into "rotate" mode.

A further feature is to automatically detect the type of media in the tape cartridge and if it is either a die cut or a wirewrap type media, automatically setting the print mode so that the end of tape sensor detects both the beginning edge of the next available label for printing as well as when the media supply cartridge is empty.

These and other features will become apparent with reference to the drawings, the description of the preferred embodiment and method and the appended claims.

DESCRIPTION OF THE DRAWINGS

FIGS. 13A-13G are examples of printed tape utilizing the present invention for printing a single line in a non-rotated format.

FIGS. 14A-14C are examples of printed tape utilizing the present invention when multiple lines are printed in a non-rotated format.

FIGS. 15A-15C are examples of printed tape in accordance with the present invention when printed with multiple lines and in a rotated format.

FIGS. 17A-17E are examples of printed tape when characters are printed vertically, both non-rotated and rotated and with the "auto size" feature enabled.

DESCRIPTION OF THE PREFERRED EMBODIMENT

Figure 1:
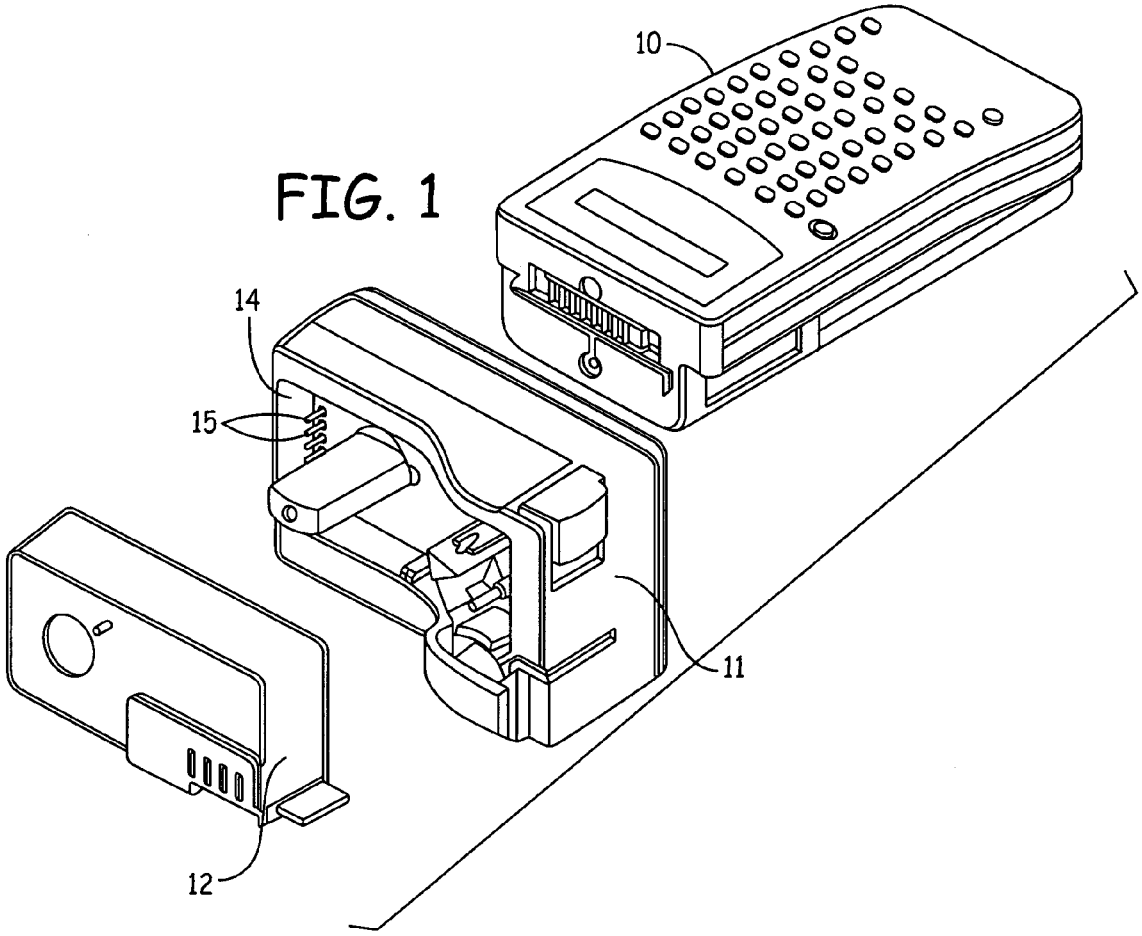
FIG. 1 is an exploded isometric view of a cartridge based tape lettering system usable with the present invention.

The present invention is directed generally to a cartridge based printing system for maximizing the size of printed characters on a strip of tape or tape media in two directions (a tape length direction and a tape width direction), for both rotated and non-rotated printing, for both normal and vertical printing and for various types of tape media such as continuous, wirewrap and die cut. As used herein, non-rotated or normal printing is printing occurring along the length of the tape with the height of the characters extending across the width of the tape. Rotated printing as used herein is printing in which the characters are printed across the width of the tape, with the height of the characters extending in the length direction of the tape. Vertical printing as used herein means printing the characters, either rotated or non-rotated, with the subsequent letters or other characters in the word or text or character string extending below the previously printed character. Single line printing in accordance with the present invention means printing of a single line, either rotated or non-rotated or either vertical or normal. Multiple line printing in accordance with the present invention means printing multiple lines, either rotated or non-rotated and either vertical or normal.

As used herein, "continuous" tape media shall mean a tape media in which the tape and release liner is substantially continuous throughout the tape length and is not separated into a series of print areas by indexing marks, by markings or cuts on the tape or otherwise.

As used herein, the term "wirewrap" or "wirewrap type" shall mean a cartridge having a tape media type which is generally used for marking wire and/or cable. Such media within the cartridge may include, but not be limited to, self-laminating tape which includes a transparent or translucent area and an opaque area to receive the printing. Generally, the opaque print or printable area will be followed by the transparent or translucent area for each wirewrap label.

As used herein, the term "die cut" or "die cut type" refers to a strip of labeling tape in which individual labels are partially cut within the elongated tape, either with a defined length dimension or a defined width dimension, or both. Accordingly, both the wirewrap and die cut media include a series of wirewrap or die cut labels, along the length of the tape, each having a print area. Each of these print areas is defined by a printable width and a printable length. Both the wirewrap and die cut type media contemplated for use in the print system of the present invention, or the release liner thereof, also include indexing marks in the media identifying the position of the next die cut label or wirewrap label. Such indexing marks could be a hole cut through the media or the release liner, a small gap in the media or release liner, a black color or other mark of contrasting color on either the front or rear sides of the tape media or liner or any other indicia identifying the print areas on the media.

The print system in accordance with the present invention is designed for use with a cartridge based tape lettering system. Such systems are known in the prior art. Two such systems are shown in FIGS. 1 and 2 and in FIGS. 3 and 4.

FIG. 1 is a lettering system similar to that disclosed in U.S. Pat. No. 5,411,339, the entirety of which is incorporated herein by reference. This print system includes a keyboard module 10 with a keyboard, a print module 11 and a replaceable tape supply cartridge 12. During use, the cartridge 12 is inserted into the cartridge cavity 14 of the print module 11.

Figure 2:
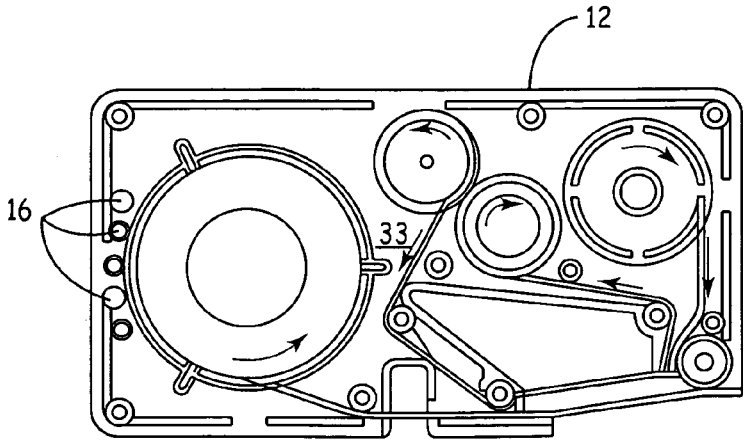
FIG. 2 is an elevational, plan view of a tape cartridge usable in the lettering system of FIG. 1, with the top cover removed.

FIG. 2 is an elevational plan view of the cartridge 12 with the top cover removed. The cartridge 12 and print module 11 include cartridge sensing and communication interface means in the form of a plurality of pins or switches 15 in the print module 11 and a plurality of openings or absence of openings 16 in the lower wall of the cartridge 12. This interface or cartridge sensing or communication means functions to provide information regarding the specific tape media in the cartridge and characteristics thereof to the central processing unit (CPU) of the print system in the manner described in the above-mentioned U.S. Pat. No. 5,411,339.

Figure 3:
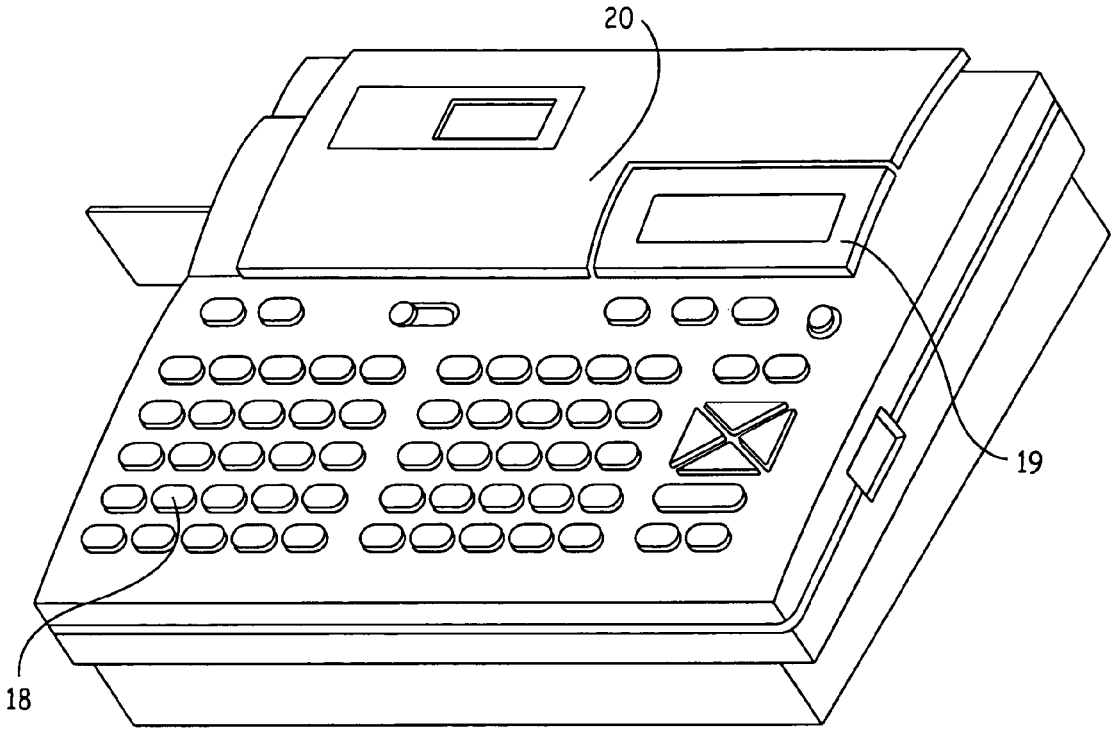
FIG. 3 is a further embodiment of a cartridge based tape lettering system usable with the present invention.
Figure 4:
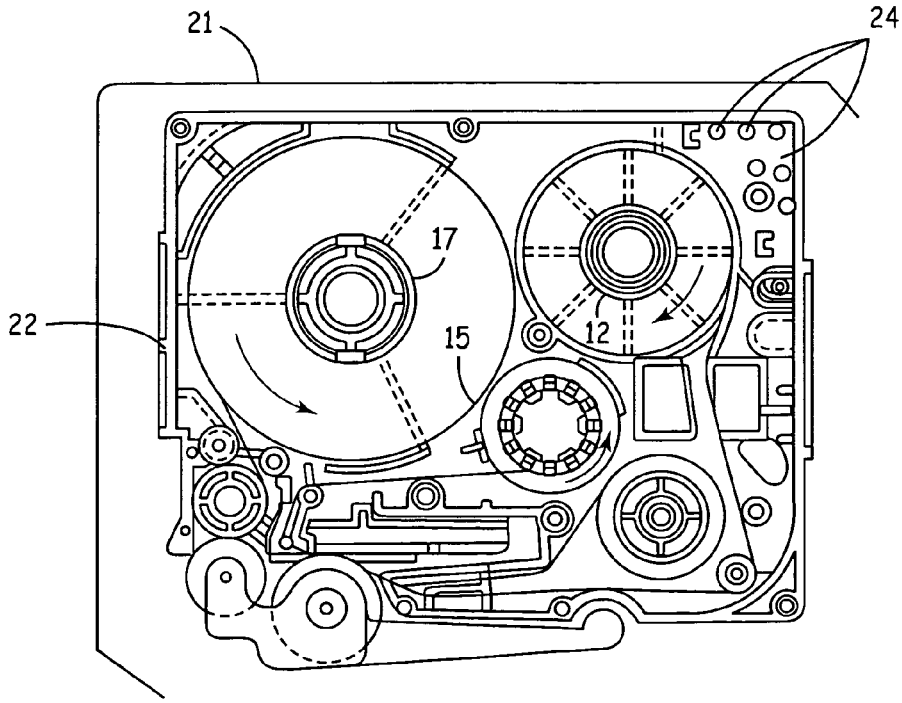
FIG. 4 is an elevational, plan view of a tape cartridge usable in the lettering system of FIG. 3, with the top cover removed.

FIG. 3 shows a further existing embodiment of a cartridge based system as described in U.S. Pat. No. 5,609,424, the entirety of which is incorporated herein by reference. This printer includes a keyboard 18, a display 19 and a cover 20 which can be opened to provide access to a cartridge receiving cavity 21 (FIG. 4). A replaceable tape supply cartridge as shown in FIG. 4 is designed for use with the printer shown in FIG. 3. Similar to the cartridge 12 of FIGS. 1 and 2, the cartridge 22 of FIG. 4 includes a plurality of holes or absence of holes 24 which mate with corresponding switches or pins in the cartridge receiving cavity. The plurality of holes or absence of holes and switches or pins provide an interface between the cartridge and the printer and function as a cartridge sensing or communication means to provide information regarding the tape media to the printer upon insertion of the cartridge 22 into the cartridge receiving cavity 21. This interface as described above, and the information communicated thereby is sometimes referred to herein as the cartridge code.

Although the ability of the printing apparatus in accordance with the present invention to maximize an image both with respect to a printable width and a printable length of a print area has applicability to all types of tape media including continuous, wirewrap and die cut, it has particular applicability to tape media which has defined print areas on the tape such as wirewrap and die cut. To function in accordance with the present invention, the printer is provided with information comprising at least the printable width and the printable length of the print area. Such information can be provided either manually from the keyboard or automatically from the cartridge code through the interface. If the tape media is continuous, the printable width is provided automatically through the cartridge code, while the printable length, if there is a limit, is provided manually via the keyboard.

On the other hand, if the tape media is wirewrap or die cut, both the printable width as well as the printable length are provided automatically via the cartridge code in accordance with the preferred embodiment. Also, in accordance with the preferred embodiment, the position of the index mark relative to the print area such as the distance from the index mark to the beginning of the next print area on a wirewrap or die cut tape media is also automatically provided via the cartridge code. If desired, the total length of the wirewrap or die cut label may also be provided. This is defined by the distance between adjacent index marks. Accordingly, by providing certain information automatically via the cartridge code (including confirmation that the tape media is a wirewrap or die cut, the printable width, the printable length and the position of the index mark relative to the next print area) an image can be maximized relative to the print area in both a printable width and a printable length dimension for a wirewrap or die cut tape media.

Figure 18A:
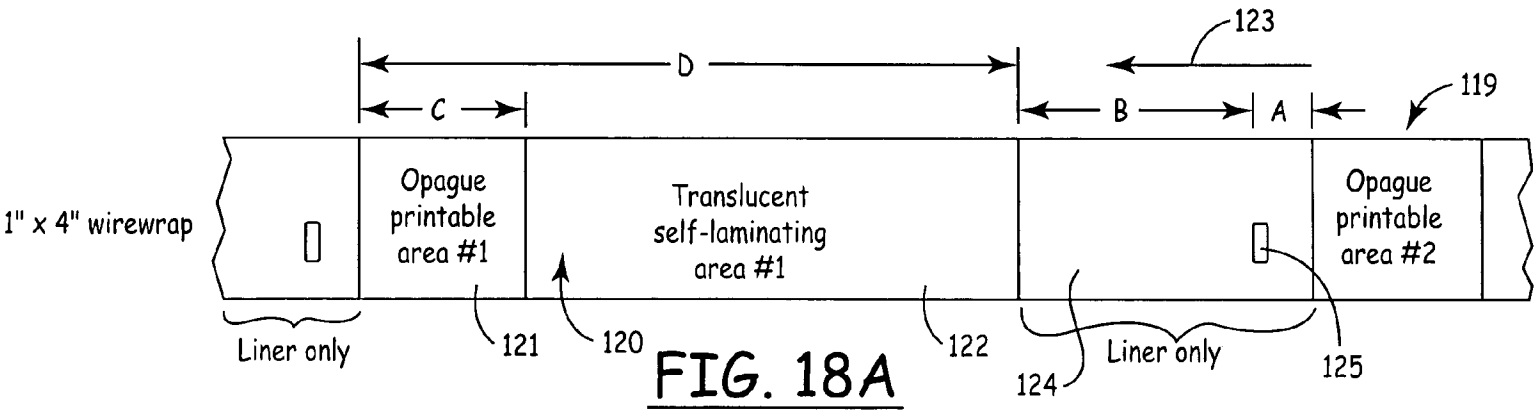
FIGS. 18A, 18B and 18C are examples of wirewrap tape media usable with the apparatus and method of the present invention.
Figure 18B:
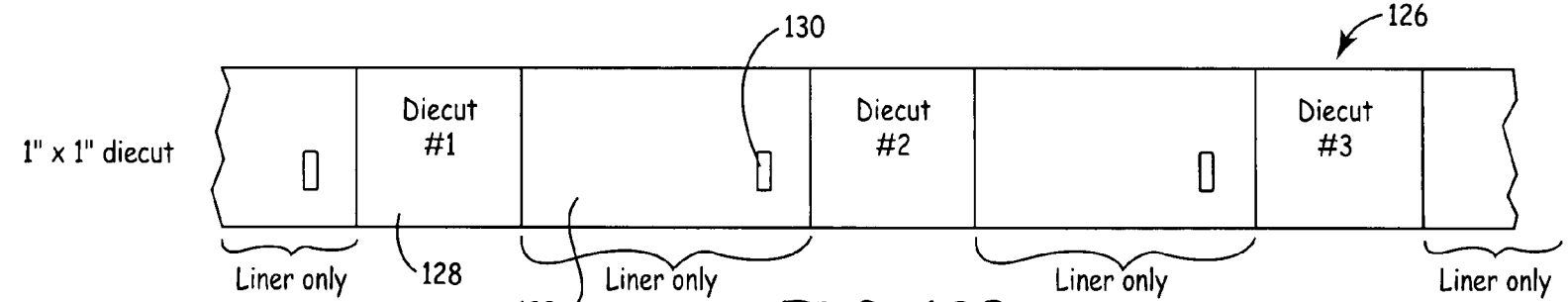
Figure 18C:
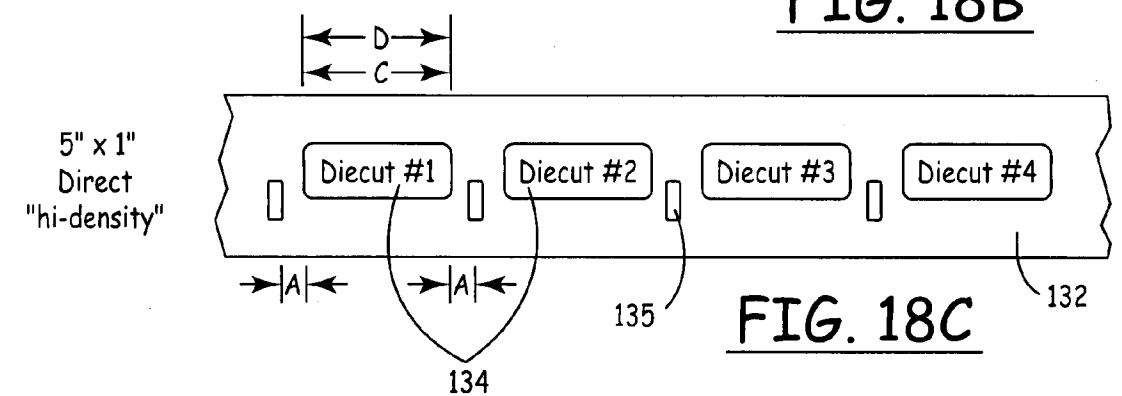

FIGS. 18A, 18B and 18C show various forms of a wirewrap tape media to which the present invention is applicable. FIG. 18A shows a wirewrap tape media 119 having a one-inch by four-inch wirewrap label 120 with a length "D". The label 120 is mounted on a release line and includes an opaque area 121 defining (or approximately defining) the print area and a translucent, self-laminating area 122. The print area 121 has length "C", a width corresponding to the tape width and is designed to receive a print image. Such image normally includes identifying indicia for a particular wire, cable or group thereof. The translucent area 122 is wrapped around the wire, cable or group thereof and over the area 121 to laminate the same. Positioned between adjacent labels 120 is a section 124 which is comprised of release liner only. This release liner section 124 includes an index mark in the form of an opening or hole 125.

As shown, the tape 119 in FIG. 18A travels from right to left through the printer in the direction 123. The distance between the index mark 125 and the beginning of the next print area 121 is shown by the dimension "A". The dimension "B" defines the distance between the index mark and the trailing end of the previously printed label.

FIG. 18B shows a wirewrap tape media embodying a plurality of direct labels 128 separated by release liner only sections 129. In the embodiment of FIG. 18B, the print area is defined essentially by the entirety of the label 128 since there is no translucent self-laminating portion. The label 128, like the label 120 of FIG. 18A, is secured to a release liner. Each release liner section 129 includes an index mark 130.

FIG. 18C shows a further embodiment of a wirewrap tape media 131 which includes a release liner 132 and a plurality of labels 134 applied to the release liner 132. An index mark 135 is positioned between each of the labels 134. In the embodiment of FIG. 18C, the dimensions of the label 134 define or approximately define the printable width and the printable length of the print areas. Also, in FIG. 18C, the labels 134 are much more closely spaced than the labels of FIGS. 18A and 18B.

Figure 5:
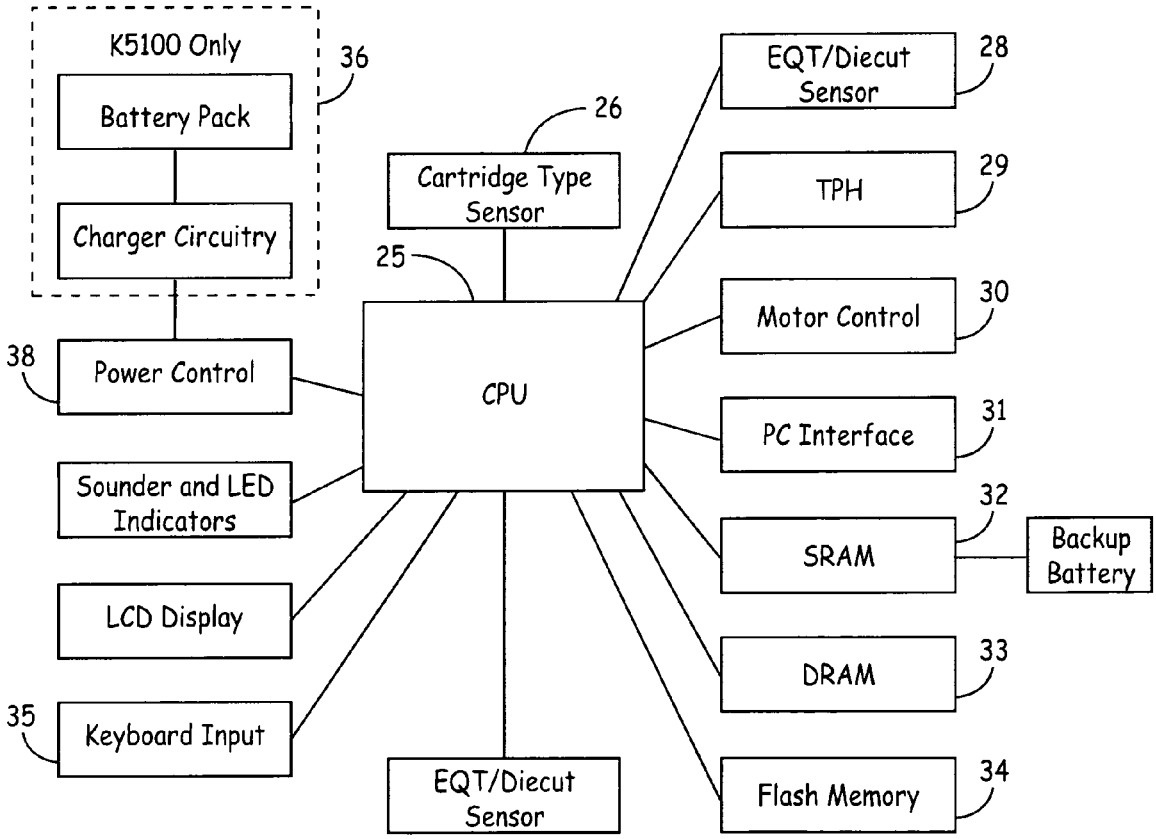
FIG. 5 is a block diagram showing the central processing unit and associated connections.

Reference is next made to FIG. 5 showing, in block schematic form, the central processing unit (CPU) 25 and the various associated components which either provide input to, receive output from, or reside within and are a part of, the CPU 25. This includes a cartridge type sensor 26 for sensing various characteristics of the inserted cartridge, and specifically the tape media within that cartridge, and an end-of-tape (EOT)/die cut sensor 28.

In the preferred embodiment, the end of tape sensor 28 is an optical sensor which is light based. Specifically, the sensor 28 is an infrared light based sensor which includes an optical emitter and an optical sensor. In the preferred embodiment, this is an Omron sensor. The optical emitter emits a beam of light or other signal across the path of the tape and the optical sensor located on the opposite side of the tape senses whether or not the beam of light or other signal is blocked. If it is blocked, this indicates the presence of tape in the area of the sensor 28 between the emitter and the sensor. If the beam of light is not blocked, it indicates that the cartridge is out of tape or that an index mark or gap in the tape is in the area of the sensor 28. In accordance with the present invention, the information received from the sensor 28 regarding the status of light or signal beam, is interpreted differently by the tape printer depending upon whether the tape media in the cartridge is continuous or whether the tape media is wirewrap or die cut. If the tape media is continuous, the printer will interpret the sensor information in a first or continuous mode, while if the tape media is wirewrap or die cut, it will interpret such information in a second or wirewrap mode.

If the media is continuous and the printer is interpreting the sensor information in the first mode, any indication that the beam or signal is not blocked will mean that the cartridge is out of tape and prompt a "cartridge empty" signal. If, however, the tape media is a wirewrap or die cut which includes individual labels with printable areas separated by index marks, and the printer is interpreting the sensor information in the second mode, the beam or signal will pass through the index mark openings. This will initially indicate that the sensor has detected an index mark or the end of the tape. However, if advancement of the tape media continues for a preselected, set distance and the beam or signal is again blocked, this indicates the presence of an index mark, and thus the next label, rather than the end of the tape. On the other hand, if advancement of the tape media continues beyond the preselected distance, this means that the sensor has not sensed an index mark and the cartridge is out of tape.

Thus, when the cartridge type sensor 26 senses the tape media as wirewrap or die cut, it will interpret information from the sensor 28 in the second or the wirewrap or die cut mode. When in this mode, the distance which the tape media must advance before the printer 28 will conclude that the cartridge is out of tape is a relatively short distance, slightly larger than the dimension size of the index gap in the tape length direction. In the preferred embodiment, this distance is fixed and limited in the printer firmware, although, if desired, it can be provided manually or via the cartridge code.

In the preferred embodiment, there is a known fixed distance from the EOT sensor and the heater elements on the thermal printhead (TPH). There is also a known fixed distance from the EOT sensor to the cut blade in the cutter assembly. One of the characteristics for die cut and wirewrap cartridge types communicated by the cartridge type sensor 26 is the distance from the indexing mark on the media to the leading edge of the die cut or wirewrap label. This allows precise positioning of the leading edge of a die cut or wirewrap label relative to the printhead for printing the label. This also allows precise advancement of the die cut or wirewrap label after printing to the cut position such that the label is not inadvertently cut into two pieces. The current invention allows for different die cut or wirewrap cartridge types with non-standard gaps between adjacent die cut or wirewrap labels. Thus, in accordance with this feature of the present invention, only a single sensor (the end-of-tape sensor) is utilized to perform two functions: the first to signal when the tape cartridge has no more media (whether the tape media is a die cut wirewrap or not) and second to identify the beginning of the next printable label when the tape media is a die cut or wirewrap.

The CPU 25 is also operationally connected with the thermal print head (TPH) 29, a motor control 30 and optionally a personal computer (PC interface 31). With the PC interface, as described in greater detail below, the print system of the present invention is able to convert and download fonts or character data from the PC for use by the printer of the present invention. When this occurs, these downloaded fonts or character data are stored in the flash memory 34 for use when disconnected from the PC.

The CPU 25 includes three types of memory: static ram or SRAM memory 32, dynamic ram or DRAM memory 33 and flash memory 34. The SRAM memory 32 functions to remember the last printed text and various user selected preferences and is backed up with a battery. Thus, when the print system is turned off and then turned back on, the last printed or prepared text will be displayed and previous modes restored.

The DRAM memory 33 is used for various functions during the operation of the printer including the formation of the output raster image and other variable data.

The flash memory 34 is memory which is electronically erasable and functions primarily to download new firmware, download fonts or character data from a PC, list the downloaded fonts and various other functions.

Font or character data in accordance with the present invention is stored in memory for each character. This includes character attributes and whether the character is ascending or descending. Preferably, this is stored as scaleable outline font or character data, however, in some aspects of the present invention, characters stored in a bit map format can be utilized as well. The memory also includes data for certain character pairs so that when the sequence of such pairs is input, a "kerning" adjustment of the inter-character spacing will be made. Data specifying line and page attributes such as framing is also stored in memory.

The keyboard input 35 functions to provide inputted data to the CPU via the keyboard from the print apparatus. Such data may include character data and setting of type size and style, various operational modes, and the like. Attributes such as font typeface, typestyle, size, etc. can be input on a character by character basis such that a label as shown in FIG. 16C can be produced. Power is supplied via the power unit 36 and the power control 38 in a conventional manner. The power unit 36 is shown as comprised of a battery pack, however, this could be provided via line voltage as well.

The keyboard to be used with the present invention includes keys for each of the characters. The keyboard to be used with the present invention also includes keys, multiple key sequences, or menu user interface selections for setting a character size, for setting a fixed length of a printed label when desired, for enabling the "auto size" feature for automatically maximizing the size of the printed characters in both a length and a width direction, for rotating the printing, for selecting vertical printing, a print key and various other standard keys. A special keyboard mode allows any character in any font to be entered even if there is not a dedicated key for that character on the keyboard. Examples would be accented characters as used in western Europe such as £¥áñö.

In accordance with the present invention, the routines as shown in FIGS. 6-12 and as described below utilize input information from the cartridge sensing/communication means upon insertion of a cartridge and various input from the user via the keyboard (or from a PC) to print characters on a strip of tape, either single or multiple line, either rotated or non-rotated, either vertical or normal and either with a limited length or not. If the "auto size" feature is selected by the user, the print system of the present invention will automatically maximize the character size of the characters to be printed in both a tape width direction and a tape length direction. This determination of maximum character size is based on the specific combination and sequence of characters which have been inputted and the particular size of each such character, the number of lines of such characters, the attributes of each character (bold, italic, underline), whether the character is ascending or descending, the attributes of each line (framed or unframed), the attributes of each label (framed, rotated, vertical), the attributes of the installed cartridge media (maximum printable width, maximum printable length), and user specified media attributes (such as printable length override, etc.), or a combination of the above. Thus, the present invention determines the width and height of each individual character in this routine. This is distinguishable from many prior art systems which essentially assume a worse case combination of characters input by assuming that all characters are the same size without kerning, and therefore does not completely maximize the selected character size. Further, the prior art fails to maximize in two dimensions for both rotated and non-rotated printing.

In accordance with the present invention, it is recognized that the characters each have differing widths, that some characters have what are referred to as ascenders (i.e., a punctuation mark over the letter) or descenders (i.e., the lower case letters "p" and "g" in which a portion of the letter extends below the baseline). These ascenders and descenders result in various characters having variable heights at a given point size.

Still further, the desired spacing between characters is dependent upon specific sequence of the characters input. This is referred to as "kerning". When certain letters are printed next to one another, the letters tend to visually interlock with one another, such as printing the upper case letter "T" followed by the upper case letter "A". If no adjustment is made, it would visually appear that the space between the letters "T" and "A" is greater than the space between other non-interlocking letters. The routine of the present invention compensates for this letter "interlock" and provides a kerning feature.

Figure 6:
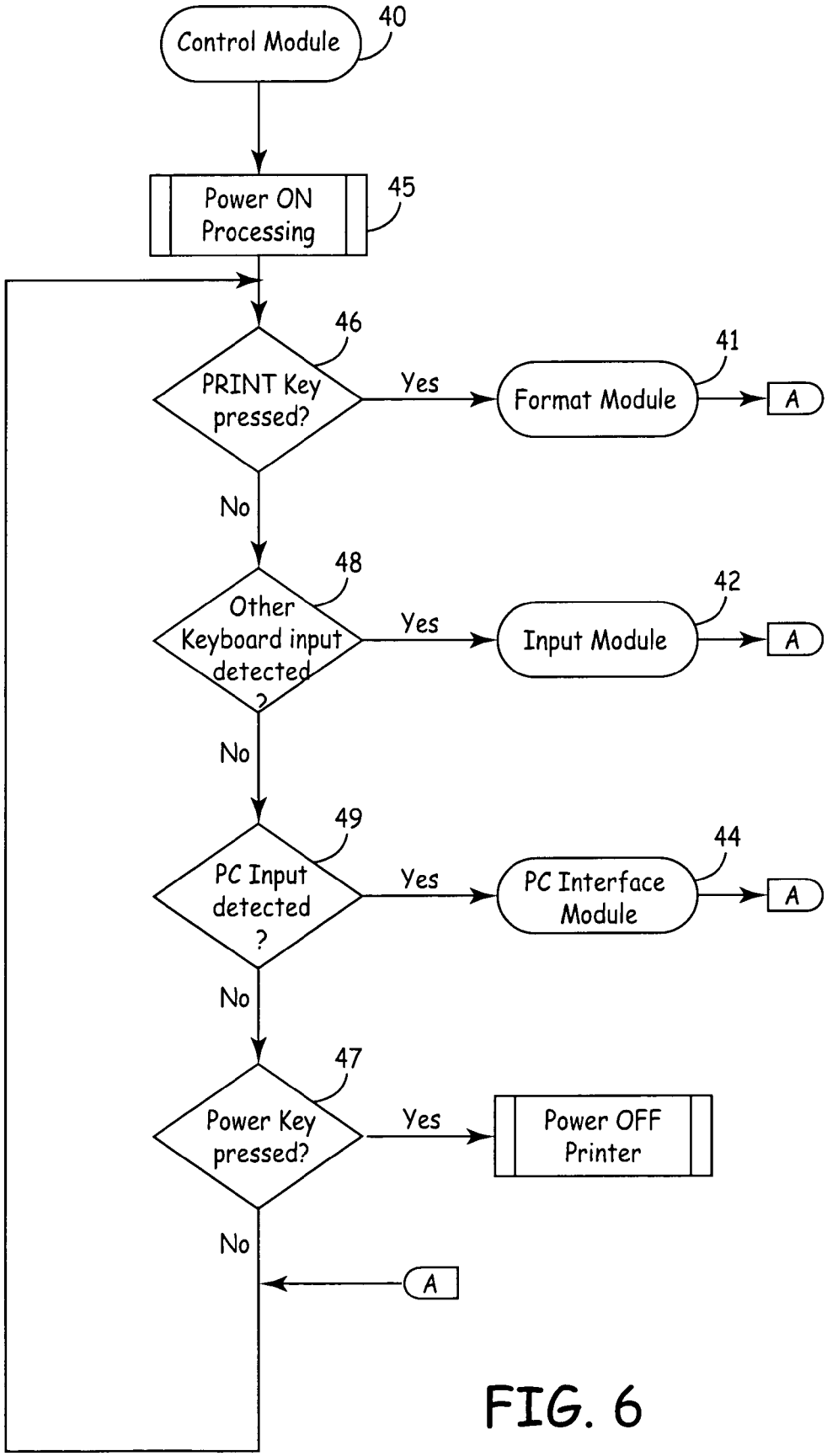
FIG. 6 is a block diagram of the control module of the printing system in accordance with the present invention.

The routine for printing the desired characters on a tape in the desired format is shown in and described with respect to FIGS. 6-12. With reference first to FIG. 6, the control module 40 monitors the sensor inputs from the inserted cartridge, keyboard activity including all keyboard input data such as characters to be printed, size of characters, lettering style, length of printable area, auto sizing, etc. and all PC input. The control module 40 then calls subroutines such as the subroutine for the format module 41, the subroutine for the input module 42 and the subroutine for the PC interface module 44 as appropriate. The control module is also responsible for the power on initialization and diagnostics via the step 45. After the power is on, the control module checks to see if the print key 46 is depressed. If the answer is "yes", the subroutine for the format module 41 is initiated. If the answer is "no", then a check is made to determine whether any other keyboard input is detected in step 48. If the answer is "yes", the subroutine for the input module 42 is initiated. If the answer is "no", a check is made as to whether there is any PC input in step 49. If the answer is "yes", the subroutine for the PC interface module 44 is initiated. If the answer is "no", this routine is repeated as shown.

It should be noted that the PC interface module 44 in the preferred embodiment is a bidirectional interface to an optionally attached PC (not shown). This interface allows a number of functions and information to be transferred between the attached PC and the tape printer system of the present invention. This includes the ability to print from the PC in which the PC printer device driver forms a raster bit map in a compressed format for use by the output module hereinafter described. Also, embedded firmware within the tape printer system of the present invention and contained in the flash memory 34 (FIG. 5) can be updated via the PC interface by transferring the updated firmware from a source accessible to the PC into the flash memory 34 of the printer. The PC interface 44 also permits PC resident scalable fonts to be converted and downloaded to the flash memory 34 of the print system. Such downloaded fonts are stored as scalable outline (not bit map) fonts as described in U.S. Pat. No. 5,081,594 or similar scalable outline format in the flash memory of the tape print system and can then be utilized either with the printer connected to the PC or disconnected from the PC. Status information relating to the print system such as installed cartridge code, internal operating temperatures and voltages, thermal print head average resistance, serial number and firmware version of the print system can be read by the PC. Certain manufacturing calibration functions are also performed via the PC interface.

It should also be noted that the control module routine 40 is always available to accept data or other input from either the keyboard input 48 or the PC input 49, if connected. This control module routine is then repeated as shown in FIG. 6.

Figure 7:
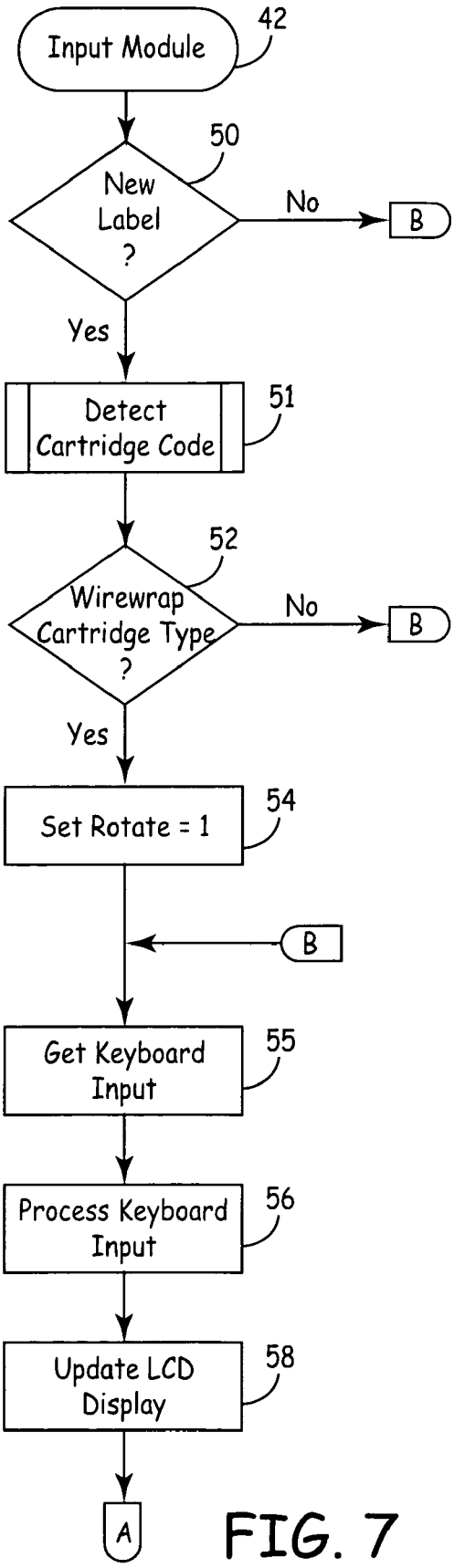
FIG. 7 is a block diagram of the input module of the printing system in accordance with the present invention.

If the control module routine detects any keyboard input at the step 48, the control module calls the input module subroutine 42 as shown in FIG. 7. The first check in the input module subroutine is to determine whether this is a new label. If the answer is "yes", the cartridge code as communicated via the cartridge sensing/communication means described above is checked as shown in step 51 to determine and input information as to type of media in the cartridge, tape width, etc. This check includes determining whether the media within the cartridge is what is referred to as a wirewrap type media. If the answer is "yes", the print format is switched to "rotate" as shown in step 52. Thus, when the media is a wirewrap type media, the default setting is to automatically print the inputted characters in a "rotated" format. If the wirewrap media check is "no", the "set rotate" step 54 is bypassed as shown and the print format remains in a "non-rotate" mode.

If the new label check in step 50 is "no", the steps 51, 52 and 54 are bypassed as shown and subroutine is continued at flag B.

The subroutine of the input module 42 continues by obtaining all of the keyboard input in step 55, processing all of the keyboard input in step 56 and updating the LCD display in step 57. When this is completed, the input module subroutine returns to the control module routine at the flag "A".

In step 56, the entire contents and attribute settings of an existing input line can be copied or cut. This can then be pasted into one or more additional lines within the label.

After all of the keyboard input has been received and processed, and the print key in step 46 (FIG. 6) is depressed, the answer to step 46 is "yes". This initiates the format module 41 subroutine shown in FIG. 8. The format module 41 functions to determine the printable length (pl) and the printable width (pw) of the allowable print area based on the cartridge media installed and all other data input and essentially formats or prepares the inputted character data to be printed onto the allowable print area.

Figure 8:
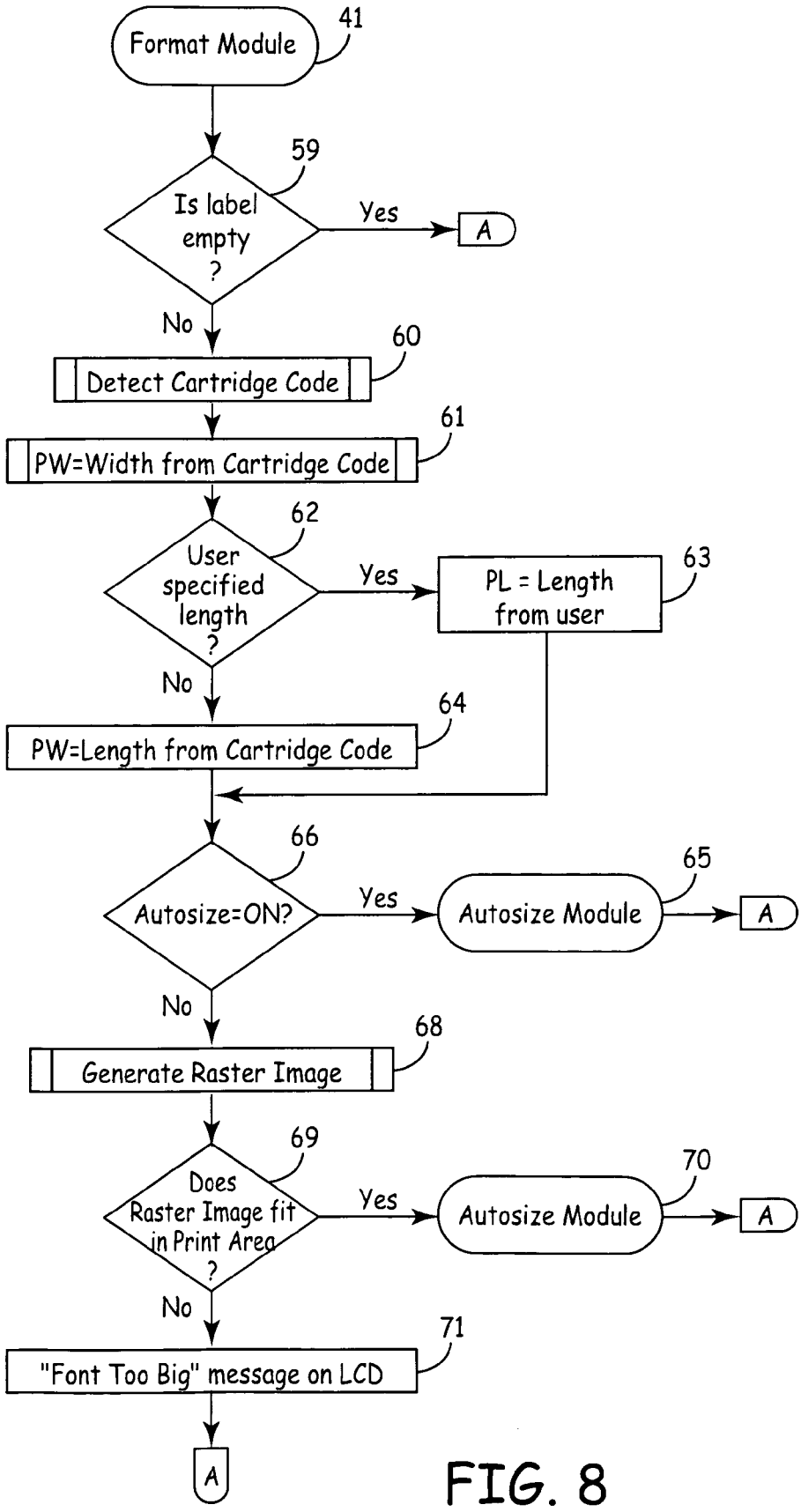
FIG. 8 is a block diagram of the format module of the printing system in accordance with the present invention.

In accordance with the subroutine of the format module 41 of FIG. 8, a check is first made to determine, in step 59, whether there is anything to print. If the answer is "no", the routine returns to the control format routine of FIG. 6 at the flag "A". If the answer is "yes", the cartridge code of the inserted cartridge is detected in step 60 and the printable width (pw) of the media within the cartridge is determined from the cartridge code in step 61.

Next, a check is made in step 62 to determine whether the user has specified a "tape length" in the keyboard input. If the answer is "yes", this keyboard inputted length is entered as the printable length (pl) at step 63 and the subroutine continues at the point shown. If no length is specified by the user in step 62 and the answer is "no", the printable length (pl) will be the length specified from the cartridge code. If the cartridge media is continuous, printable tape, this printable length (pl) will be 20 inches as a default. However, if the tape media is a die cut label or a wirewrap, both of which have defined, relatively short media lengths upon which to print, this permitted printable length will be communicated and sensed upon insertion of a cartridge and that length will become the printable length (pl) as shown in step 64.

The format module 41 subroutine then determines whether the "auto size" feature has been selected. If the answer is "yes", the subroutine for the auto size module 65 is initiated and that subroutine is followed as described below. If the answer is "no", a raster image is generated in step 68. This raster image is generated based on all of the keyboard input from the user and a bit-by-bit/pixel-by-pixel pattern is created for the image to be printed. During this rasterization step 68, the raster image is generated utilizing the individual character widths, kerned character spacing and other character, line and page attributes.

Next, a check is made in step 69 as to whether the generated raster image will fit in the allowable print area. If the answer is "yes", the output or print module 70 subroutine is initiated. If the answer is "no", the LCD displays a "font too big" message in step 71. The routine will then return to the control module routine of FIG. 6 at the flag "A". The user will then usually either select a smaller character size or select the "auto size" feature, followed by a depression of the print key and the subroutine will be repeated.

Figure 9:
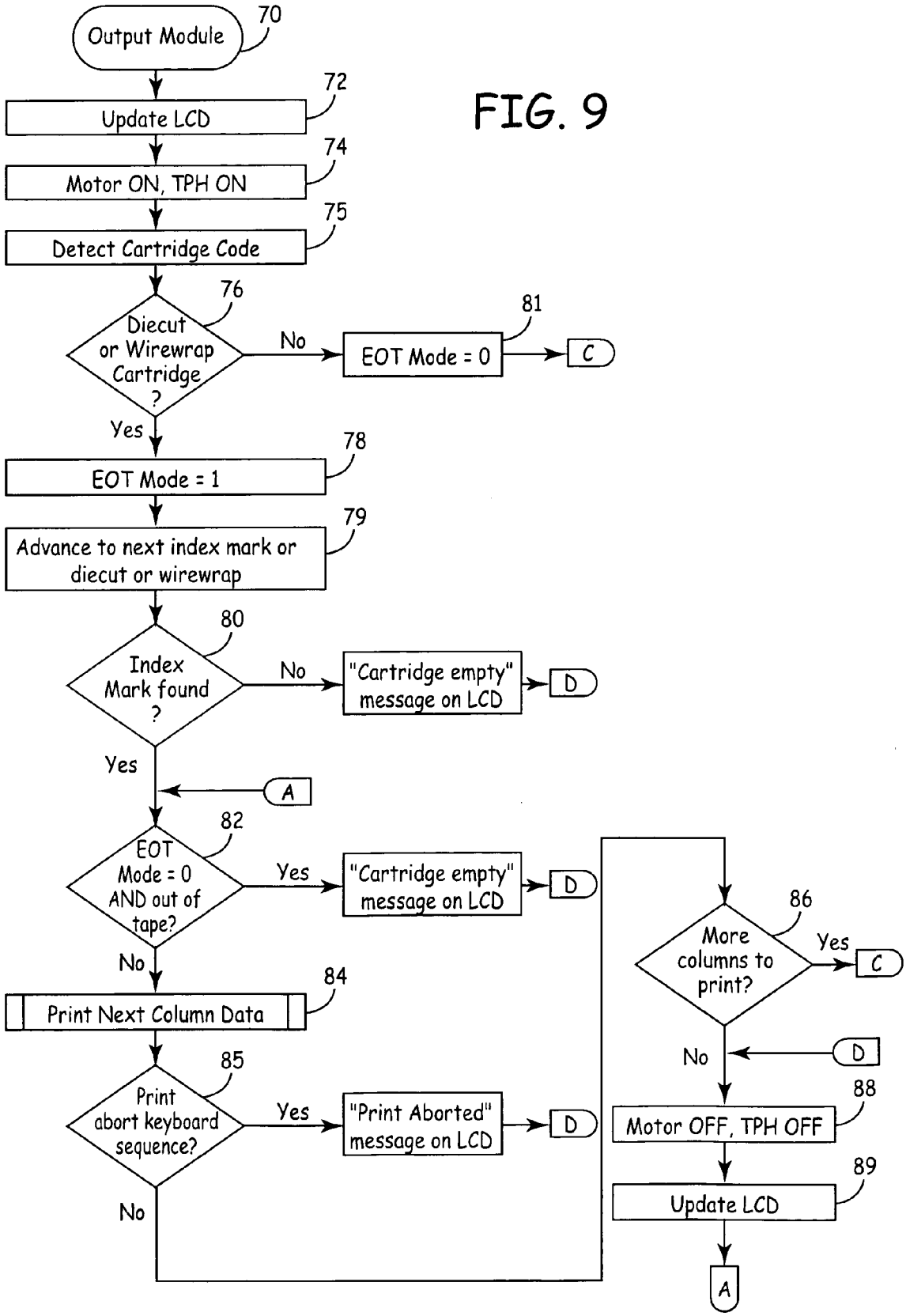
FIG. 9 is a block diagram of the output module of the printing system in accordance with the present invention.

If the raster image in step 69 fits within the allowable print area and accordingly the answer is "yes", the subroutine of the output module 70 will be initiated as shown in FIG. 9. The output module 70 controls output of the raster image to the media in the installed cartridge. The output module controls the media and ribbon stepper motor and the loading and control of the TPH (thermal print head). This module 70 also monitors several sensor inputs including the battery pack voltage, thermal print head temperature, end of tape (EOT) sensor and cut switch activation. The output module also displays messages on the LCD and alters behavior of the print system based on these inputs. If the inserted cartridge type is either a wirewrap or a die cut type, then the end of tape (EOT) sensor usage is altered to allow indexing of the media such that the position of the printed output can be precisely controlled along the longitudinal axis of the media.

More specifically, the subroutine of the output module 70 first updates the LCD in step 72 and checks to make sure that the motor and the thermal print head are on in step 74. The cartridge code is also checked in step 75 to determine whether the cartridge media is either a die cut or a wirewrap type as in step 76. If the answer is "yes", the end of tape (EOT) mode is set at 1 pursuant to which the EOT sensor will be utilized to sense a gap or index mark in the media and advance the media in step 79 such that the beginning of the next die cut or wirewrap will be positioned at the heater elements on the TPH (thermal printhead). If the EOT sensor fails to detect a gap or index mark, as in step 80, this will indicate that the cartridge is out of media and a "cartridge empty" message will be displayed. In the preferred embodiment, the index mark is a short gap or a hole in the media or release liner of a known fixed width which the EOT sensor can detect and identify as the label. If the gap continues and is thus longer than this known fixed width, the EOT sensor detects this as the cartridge being out of tape or media. For die cut and wirewrap labels, the EOT sensor is used to perform two functions: detecting the beginning position of the next label and indicating an empty cartridge.

If the determination in step 76 is that the cartridge media is not a die cut or wirewrap type, the EOT mode or sensor is set at 0 (which functions in its normal mode only as an "out of tape" sensor) and the output module subroutine bypasses the steps 78, 79 and 80 as shown. At this point, a determination is made as to whether the cartridge media (which at this point is determined to be not a die cut or wirewrap type) is out of tape. If the answer is "yes", a "cartridge empty" message will appear in the LCD. If the answer is "no", the first or the next column of data is printed in step 84.

The keyboard also has a print abort key sequence. If this is activated, the answer in step 85 is "yes" and the print step and output module subroutine will be aborted. If the answer is "no", the subroutine will determine whether there are more columns to print as in step 86. If the answer is "yes", the loop is repeated beginning at the flag "C" until printing has been completed. When printing is completed and there are no more columns to print, the answer to step 86 is "no", the printed media is advanced to cut, either manually or automatically. The motor and thermal print head are then turned off in step 88, the LCD is updated in step 89 and the subroutine returns to the control module subroutine (FIG. 6) at the flag "A".

Figure 10:
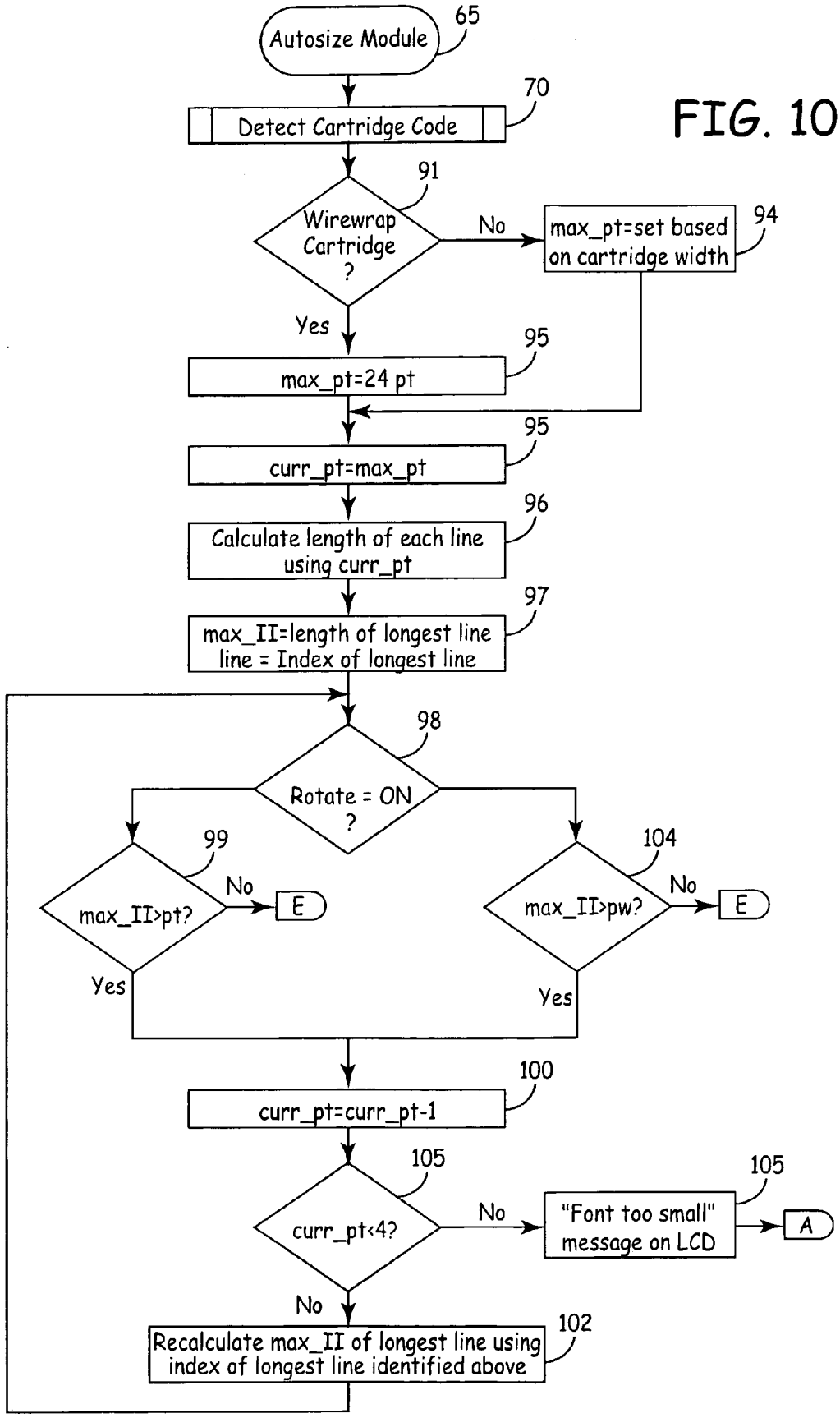
FIG. 10 is a block diagram of a first portion of the auto size module of the printing system in accordance with the present invention.
Figure 11:
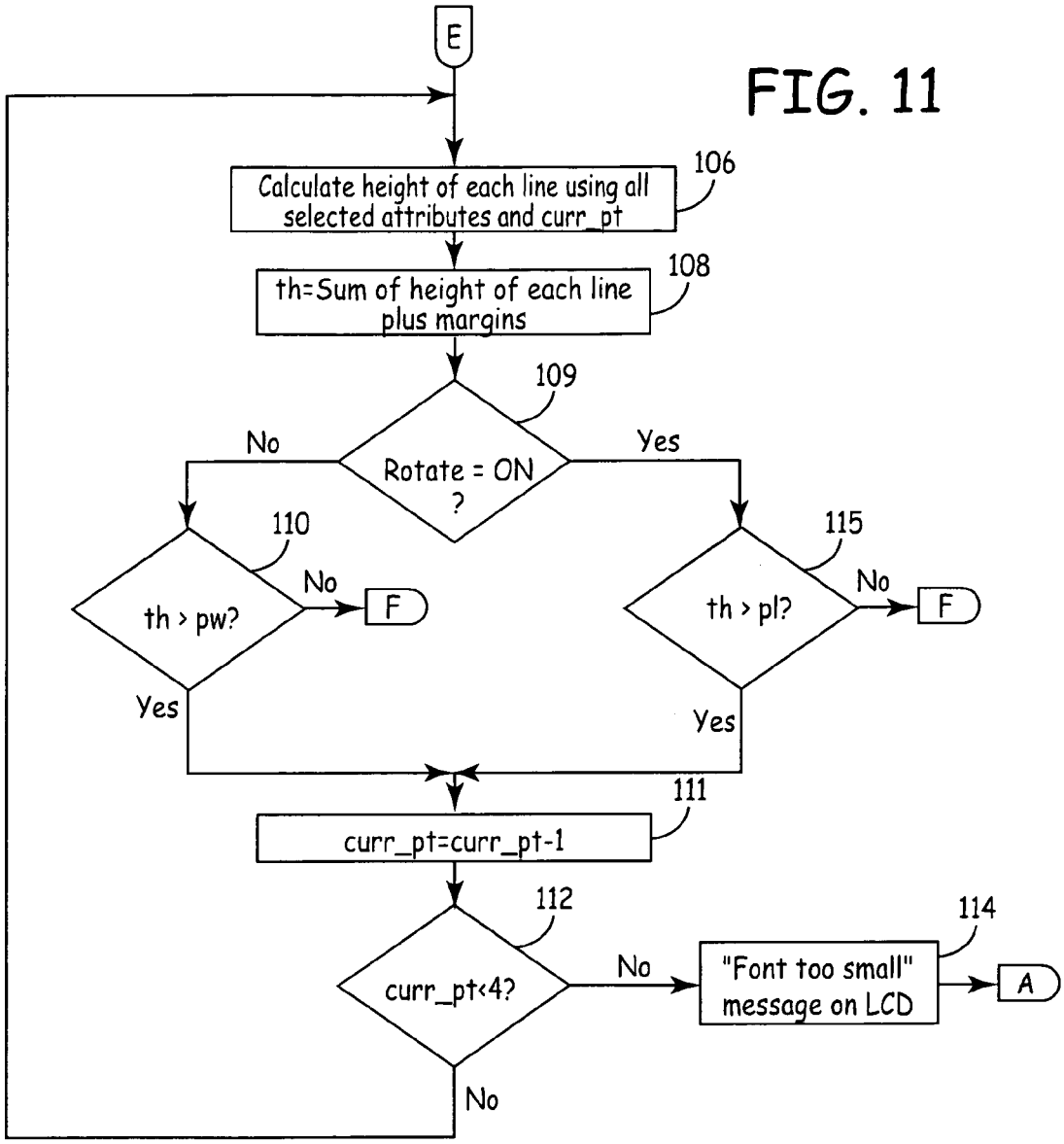
FIG. 11 is a block diagram of a second portion of the auto size module of the printing system in accordance with the present invention.
Figure 12:
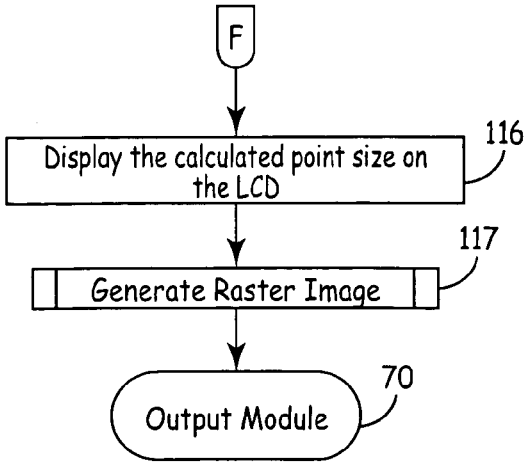
FIG. 12 is a block diagram of a third portion of the auto size module of the printing system in accordance with the present invention.

If the "auto size" feature has been selected by the user, the "auto size" subroutine as described in FIGS. 10, 11 and 12 will be utilized to essentially determine and maximize the character point size at which the inputted characters will be printed. This determination will be made in two tape directions, namely, a tape width direction and a tape length direction. Further, this determination will be made utilizing the individual widths and heights of all characters which have been inputted, as well as all other attributes of the characters, lines and pages to be printed. The auto size subroutine will also check the cartridge code and for wirewrap only, set the maximum character point size at 24 pt. Accordingly, the auto size module 65 detects the cartridge type installed in the printer and, based upon that input and the keyboard input from the user, determines the maximum size of characters that can be printed on the allowable print area. As shown, the auto size module first detects, in step 90, the cartridge type which is installed in the printer and determines in step 91 whether the media in that cartridge is a wirewrap type. In the case where this answer is "yes", the maximum character point size (max_pt) is determined to be 24 pt in step 92. For all other cartridge types, the answer to step 91 is "no" and the maximum character point size (max_pt) is determined and set based on the printable width of the cartridge media as in step 94. The subroutine then continues with the maximum character point size (max_pt) becoming the current maximum character point size (curr_pt) in step 95. Thus, the current maximum character point size (curr_pt) at this point in the case of a wirewrap media is 24 pt and is the point size based on the cartridge width for all other media.

Next, in step 96, the length in pixels is calculated for each individual line of the label. This calculation is done first by using the scalable font engine to determine the width of each character on each line using the selected attributes of each such character, and the line and page attributes as well. In general, the width of each character within a font and type face will be different. If the necessary type face for the selected font is not resident in the printer, it may be algorithmically simulated. For example, in the case of a missing italic type face, the regular type face is merely altered with an oblique transformation to simulate the italic type face. In the case of a missing bold type face, it too is simulated algorithmically. This may be necessary if only certain fonts and type faces have been loaded into the printer from a PC. In such event, the algorithm in the present invention will simulate the desired type face. As part of determining the length of each line, intercharacter spacing is adjusted using certain kerning pairs of letters unique to and stored with each font and type face.

Next, in step 97, the longest line (max_ll) is determined and set as the index of the longest line as shown in step 97 and is subsequently used to reduce the character point size as may be necessary. If the rotate mode in step 98 is off, meaning the answer to step 98 is "no" and the inputted text will be printed along the length of the media, the maximum length of the longest line (max_ll) will be compared to the printable length (pl) of the media in step 99. If the maximum line length (max_ll) is greater than the printable length (pl), the text at the current maximum character point size will not fit on the label and the current maximum character point size (curr_pt) is reduced by 1 in step 100. In step 101, this new current maximum point size (curr_pt) is compared to the minimum point size (4 pt). If curr_pt is greater than 4 pt, then the length of the longest (max_ll) line is recalculated in step 102 at the new curr_pt and the process is repeated until the recalculated current maximum character point size (curr_pt) is not greater than the printable length (pl). When that occurs, the answer to step 99 will be "no" and the subroutine will proceed to the routine designated by flag "E" as shown in FIG. 11 and described below.

If the rotation mode in step 98 is on, meaning the answer to step 98 is "yes", the current maximum character point size (curr_pt) is compared to the printable width (pw) of the media in step 104. If the maximum line length (max_ll) is greater than the printable width (pw), then the current maximum character point size (curr_pt) is reduced by 1 in step 100 to obtain a new curr_pt Again, if curr_pt is greater than the minimum point size (4 pt) in step 101, the length of the longest line (max_ll) is recalculated at the new curr_pt and the process is repeated until the length of the longest line (max_ll) is not greater than the printable width in step 104. When this occurs, the answer to step 104 is "no" and the subroutine proceeds to the routine designated by flag "E" in FIG. 11.

The minimum character point size for the print system of the present invention is arbitrarily set to 4 pt for the current embodiment based on a 300 dot per inch (dpi) resolution of the thermal print head. At smaller sizes, the text becomes difficult to read. If the current maximum character point size (curr_pt) is less than 4 pt in step 101, an error message is displayed on the LCD indicating that the character size is "too small" to print as in step 105 and the print process is terminated.

Once a current maximum character point size (curr_pt) is found using the steps in FIG. 10 in the first axis (the length axis in a non-rotated mode and the width axis in a rotated mode), a similar process is applied in the second axis (the length axis in a rotated mode and the width axis in a non-rotated mode). This process is applied along the height of a single line or the combined height of all lines. This process is shown by the subroutine indicated as flag "E" in FIG. 11. First, the height of each line (which includes line spacing for multiple lines) is calculated using the current maximum character point size (curr_pt) as determined in the initial subroutine of FIG. 10 and including the height of each individual character in each line and all selected line and character attributes. The total height (th) is then calculated as the sum of the heights of each line plus margins and page attributes where applicable. This is done in steps 106 and 108. If the rotate mode is off as determined in step 109, and the answer is, "no", a comparison is made between the total height (th) and the printable width (pw) in step 110. If the total height (th) is determined in step 110 to be greater than the printable width (pw), then the current maximum character point size (curr_pt) is reduced by 1 and that new reduced current maximum point size (curr_pt) is compared to the minimum point size (4 pt). If the current maximum character point size is less than 4 pt, as determined in step 112, an error message is displayed on the LCD as in step 114 indicating that the character size is "too small to print" and the print process is terminated.

If the current maximum character print size (curr_pt) is greater than the minimum point size (4 pt), then the total height (th) is recalculated at the new current maximum character point size (curr_pt) and the process is repeated until the total height is not greater than the printable width or the new current maximum character point size is less than 4 pt If the total height (th) is not greater than the printable width (pw), the answer to step 110 is "no" and the process proceeds to the routine designated by the flag "F" in FIG. 12.

If the rotate mode in step 109 is on so that the answer is "yes", a comparison is made between the total height (th) and the printable length (pl) in step 115. If the total height (th) is greater than the printable length (pl), then the current maximum character point size (curr_pt) is reduced by 1 in step 111. If this new current maximum character point size (curr_pt) is greater than the minimum point size (4 pt) as determined in step 112, then the total height (th) is recalculated at the new curr_pt and the process is repeated until the total height (th) is not greater than the printable length (pl) or the new current maximum character point size is less than the minimum point size (4 pt).

If the new curr_pt is less than 4 pt, then an error message is displayed as in step 114 on the LCD indicating that the character size is "too small" to print and the print process is terminated.

If the total height (th) is not greater than the printable length (pl) in step 115, the process proceeds to the routine designated by the flag "F" in FIG. 12.

In FIG. 12, the subroutine designated as flag "F" displays the calculated point size on the LCD in step 116. Next the raster image is generated in step 117 as previously described with respect to step 68 and then proceeds to the output module subroutine 70 as set forth in FIG. 9 to print the label.

Having described the details of the print system in accordance with the preferred embodiment of the present invention, examples of printed tape or printed labels in accordance with the present invention are shown in FIGS. 13, 14, 15, 16 and 17 using the "auto size" feature.

FIGS. 13A-13G show a single line, non-rotated normal printing of a label at various identified conditions. Specifically, for FIG. 13A, the length is indicated as being "auto". Thus, it has no practical limitation. In this case, the height of the letters are maximized at 72 pt for the width of the subject media.

In FIG. 13B, the length is again set at "auto" so it is of no practical limitation, but the "A" has a ring at its top, an ascending attribute of the character. Although the maximum point size (72 pt) has not been changed, it can be seen that the baseline of the text has been lowered so as to center the printed characters between the edges of the tape media.

In FIG. 13C, the length is again set at "auto" and the printed text includes a lower case "g", a descending attribute. When the "auto size" routine is applied to these characters, the existence of the descending character "g" causes the maximum character point size to be reduced to 70 pt.

FIG. 13D includes both a capital "A" with a ring over the top and a lower case "g". Thus, it includes characters with both ascending as well as descending attributes. This results in the maximum character size being reduced to 60 pt.

FIG. 13E includes both ascender and descender characters as well as a page frame. As shown, this further reduces the maximum character point size to 52 pt.

In FIG. 13F, the user has set a "length" for the label at 3.0 inches. Using the "auto size" routine of the present invention, the maximum character size is determined relative to both the printable length (3.0 inches) as well as the printable width defined by the cartridge sensor input. The resulting maximum point size is 49 points.

In FIG. 13G, the user has set the length at 1.0 inches. In this case, the "auto size" routine in accordance with the present invention has determined the maximum character size that can be printed, given the limitations of the two dimensions (length and width), is 16 pt and has centered the line in the center of the print media.

FIGS. 14A, 14B and 14C show multiple line text in a non-rotated mode. In all these figures, the length is set on "auto", thus it is of no practical limitation. In FIG. 14A, the size of the characters has been maximized on three lines within the width of the print media and a point size of 24 pt has been determined. FIG. 14B differs in that line 2 is framed. This is a line attribute of the printed material and has the effect of reducing the maximum character size. Accordingly, in 14B the maximum character size is 21 pt. FIG. 14C includes both a line frame in line 2 and a page frame extending around the entire print material. This further reduces the maximum character size. Accordingly, the maximum character size for FIG. 14C is 19 Pt.

FIGS. 15A, 15B and 15C show characters which have been printed in the "rotate" mode. For FIGS. 15A, 15B and 15C, the length is set at "auto". Thus, there is no practical limitation in the length dimension. However, there is in the width dimension that is limiting. In FIG. 15A, the auto size routine calculates and prints the maximum character size at 11 pt as shown. In FIG. 15B, because of the existence of a line attribute in the longest line, the maximum character point size is reduced to 10 pt.

In FIG. 15C, a page attribute around the entire print block has been added, while still retaining the line frame around the longest line. This has a result of further reducing the maximum point size to 9 Pt.

Figure 16A:
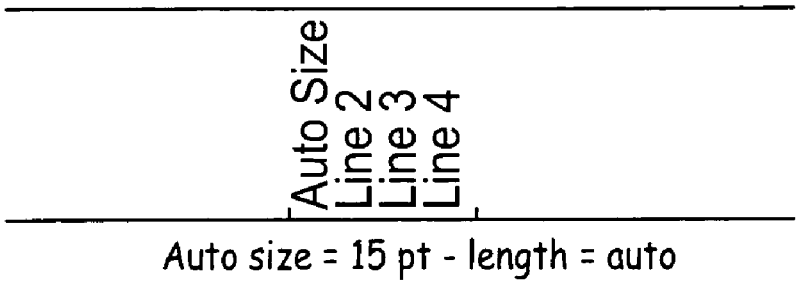
FIGS. 16A and 16B are examples of printed tape in accordance with the present invention when printed in a rotated format and multiple lines utilizing the "auto size" feature.
Figure 16B:
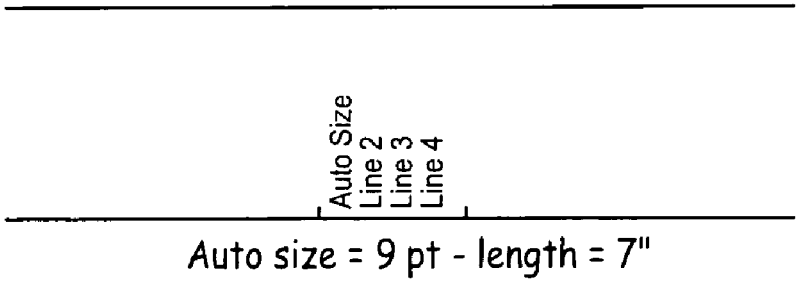
Figure 16C:
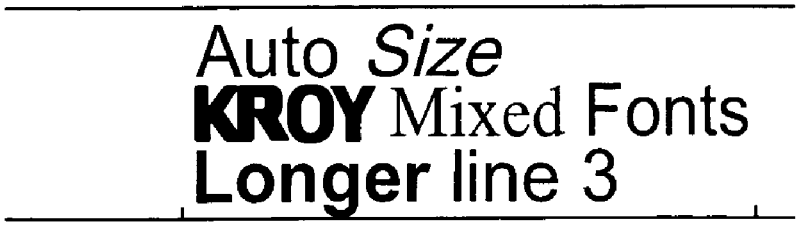
FIG. 16C is an example of printed tape in accordance with the present invention when multiple lines are printed in a non-rotated format that also incorporates multiple fonts and multiple character attributes.

FIG. 16A and FIG. 16B show printing of multiple lines in a rotate mode with both a length set at "auto" (FIG. 16A) and a length set at 0.7 inches (FIG. 16B). As shown, because there is no practical printable length limitation in FIG. 16A, the character point size is maximized for the media width. In FIG. 16B, however, because of the length limitation of 0.7 inches, which has been input by the user or determined from the cartridge code, the maximum character point size is reduced to 9 Pt. FIG. 16C shows a multiple line label with the length set at "auto" that also incorporates multiple fonts and multiple character attributes (italic and bold in this example). In this example, the specific characters input, the fonts selected for those characters, and the attributes of those characters all are utlizied to maximize the character point size for the media width.

FIGS. 17A, 17B, 17C, 17D, and 17E show examples of printing in the vertical mode both along the longitudinal axis of the media (FIGS. 17A, 17B, 17D, and 17E) and perpendicular to it (FIG. 17C). In FIGS. 17A, 17D, and 17E, the "rotate" mode is off and the length is set at "auto". Accordingly, the limiting dimension for the printing is the width of the tape and the label is printed at a maximum character point size of 69 pt. FIGS. 17D and 17E show the effect in spacing along the longitudinal axis when a letter with a descender characteristic ("g" in FIG. 17D) is replaced with a non-descender character ("a" in FIG. 17E). In FIG. 17B, a length limitation of 3.0 inches is put in by the user. Thus, the maximum character point size is adjusted to fit within this length, as well as within the width of the media and the maximum character point size has been reduced to 38 pt.

In FIG. 17C, the "rotate" mode is on, and the length is set at "auto". In this case, the maximum character point size for this particular tape width is 11 pt.

Although the description of the preferred embodiment has been quite specific, it is contemplated that various modifications could be made without deviating from the spirit of the present invention. Accordingly, it is intended that the scope of the present invention be dictated by the dependent claims rather than by the description of the preferred embodiment.

The invention claimed is:

1. A method of printing an image on a tape media by a tape printer having access to stored character data comprising:

providing a tape printer and a cartridge with tape media therein, said tape media having a tape width and a tape length and said tape printer and said cartridge having an interface to provide said tape printer with information regarding said tape media;

composing an image to be printed from said character data, said image having an image width and an image length which varies with character size;

determining a print character size which maximizes the size of said image relative to a print area on said tape media defined by a printable width and a printable length by comparing one of the image width and the image length using an incrementally reduced character size to said printable length and printing said image using said incrementally reduced character size if it fits within said printable length or, if it does not fit within said printable length, further reducing said incrementally reduced character size incrementally until the one of said image width and image length fits within said printable length; and printing said image in said print area using said print character size.

2. The method of claim 1 including determining said printable width via said interface.

3. The method of claim 1 wherein said tape media is wire-wrap and in which said image is maximized relative to said print area and is printed in a rotated format.

4. A method of printing an image on a tape media by a tape printer having access to stored character data comprising:

providing a tape printer and a cartridge with tape media therein, said tape media having a tape width and a tape length and a series of print areas along said tape length, each of said print areas defined by a printable width and a printable length, said tape printer and said cartridge having an interface to provide said tape printer with information regarding said tape media;

composing an image to be printed from said character data, said image having an image width and an image length which varies with character size;

determining said printable width and said printable length from said interface;

maximizing the size of said image relative to a said print area, wherein maximizing the size of said image relative to said print area comprises:

determining a first character size which maximizes one of said image width and image length relative to one of said printable width and said printab1e length; and determining a second character size which maximizes the other of said image width and image length relative to the other of said printable width and said printable length; and printing said image in said print area.

5. The method of claim 4, wherein printing said image in print area comprises printing said image in said print area with the smaller of said first character size and said second character size.

6. A method of printing an image on a tape media by a tape printer having access to stored character data comprising:

providing a tape printer and a cartridge with tape media therein, said tape media having a tape width and a tape length and said tape printer and said cartridge having an interface to provide said tape printer with information regarding said tape media;

composing an image to be printed from said character data, said image having an image width and an image length which varies with character size;

determining a print character size which maximizes the size of said image relative to a print area on said tape media defined by a printable width and a printable length, the printable width being determined via said interface; and comparing one of the image width and the image length using an incrementally reduced character size to said printable length and printing said image using said incrementally reduced character size if it fits within said printable length or, if it does not fit within said printable length, further reducing said incrementally reduced character size incrementally until the one of said image width and image length fits within said printable length.

7. A method of printing an image on a tape media by a tape printer having access to stored character data comprising:

providing a tape printer and a cartridge with tape media therein, said tape media having a tape width and a tape length and a series of print areas along said tape length, each of said print areas defined by a printable width and a printable length, said tape printer and said cartridge having an interface to provide said tape printer with information regarding said tape media;

composing an image to be printed from said character data, said image having an image width and an image length which varies with character size;

determining said printable width and said printable length from said interface;

determining the character size which maximizes the image width relative to the one of the printable width and printable length and comparing the image length using said character size to the other of the printable width and printable length and reducing said character size if necessary until said image length fits within the other of said printable width and printable length; and printing said image in said print area.

8. The method of claim 7 further comprising automatically maximizing the size of said image relative to said print area in a rotated format.

9. The method of claim 8, wherein the tape media is wiretap or die cut.

10. The method of claim 7, wherein the tape media has index marks between adjacent print areas.

11. The method of claim 10, further comprising providing said printable width, said printable length, and the position of each index mark via said interface.

12. The method of claim 10, wherein the tape printer comprises an end of tape sensor and the method further comprises using the end of tape sensor to detect the index marks.

* * * * *